US007706118B2

(12) United States Patent
Yang

(10) Patent No.: US 7,706,118 B2
(45) Date of Patent: Apr. 27, 2010

(54) OPERATIVE CONTROL CIRCUIT OF MULTIPLE ELECTROMAGNETIC ACTUATING DEVICES IN SERIES AND PARALLEL CONNECTION

(76) Inventor: Tai-Her Yang, 6F-5, No. 250, Sec. 4, Chung Hsiao E. Rd., Taipei (TW) 10692

( * ) Notice: Subject to any disclaimer, the term of this patent is extended or adjusted under 35 U.S.C. 154(b) by 0 days.

(21) Appl. No.: 12/076,984

(22) Filed: Mar. 26, 2008

(65) Prior Publication Data

US 2009/0244801 A1 Oct. 1, 2009

(51) Int. Cl.

| | |
|---|---|
| ***H01H 9/00*** | (2006.01) |
| ***H01H 47/00*** | (2006.01) |
| ***H01H 51/22*** | (2006.01) |
| ***H01H 57/30*** | (2006.01) |
| *H01H 47/14* | (2006.01) |
| *H01H 47/04* | (2006.01) |

(52) U.S. Cl. ..... 361/160; 361/166; 361/206

(58) Field of Classification Search ..... 361/160, 361/166, 206

See application file for complete search history.

(56) References Cited

U.S. PATENT DOCUMENTS 3,361,939 A * 1/1968 Smith La Vergne ..... 361/155
5,924,435 A * 7/1999 Wall et al. ..... 137/1
7,012,795 B2 * 3/2006 Fasano et al. ..... 361/115
7,073,524 B2 * 7/2006 Chian ..... 137/1
2007/0145316 A1 * 6/2007 Morikawa ..... 251/129.05
2008/0111512 A1 * 5/2008 Theunissen et al. ..... 318/466
2009/0140188 A1 * 6/2009 Kunz et al. ..... 251/129.15

* cited by examiner

*Primary Examiner*—Ronald W Leja
*Assistant Examiner*—Dharti H Patel
(74) *Attorney, Agent, or Firm*—Bacon & Thomas, PLLC

(57) ABSTRACT

An operative control circuit of multiple electromagnetic actuating devices in series and parallel connections, wherein individually installed driving coils of two or more than two electromagnetic actuating devices being operatively controlled by a switching device to appear lower impedance in parallel connection or series and parallel connection for electrification thereby producing a larger electromagnetic actuating power is switched to appear relatively higher impedance in series connection or series and parallel connection thereby reducing currents passing through driving coils while required operating characteristics for individual electromagnetic actuating devices after electrification are still satisfied.

20 Claims, 2 Drawing Sheets

OPERATIVE CONTROL CIRCUIT OF MULTIPLE ELECTROMAGNETIC ACTUATING DEVICES IN SERIES AND PARALLEL CONNECTION

BACKGROUND OF THE INVENTION (a) Field of the Invention

The present invention is mainly related to the individually installed driving coils of two or more than two electromagnetic actuating devices, wherein driving coils individually installed by the two or more than two electromagnetic actuating devices is operatively controlled by the switching device to actuate and be electrified to appear relatively lower impedance in parallel connection or series and parallel connection wherein after the electromagnetic actuating devices are actuated, the driving coils individually installed by the two or more than two electromagnetic actuating devices being operatively controlled by the switching device is switched to appear relatively higher impedance in series connection or series and parallel connection thereby reducing currents passing through driving coils while required operating characteristics for individual electromagnetic actuating devices after electrification are still satisfied thereby saving electric power and reducing heat loss in the driving coils of the electromagnetic actuating devices.

(b) Description of the Prior Art

In the conventional method by passing currents through the driving coils to produce the electromagnetic effect for driving the two or more than two individual electromagnetic actuating devices, the coil electrification status remains unchanged when the electrification status is actuated and held, i.e. the required excited currents for actuating and holding electrification are the same, therefore it has the disadvantages of the high heat loss and wasting electric energy.

SUMMARY OF THE INVENTION

The present invention discloses an operative control circuit of multiple electromagnetic actuating devices in series and parallel connections which is through the switching device to operatively control two or more than two electromagnetic actuating devices individually installed with driving coils including applications for normal close or normal open type electromagnetic brakes, normal close or normal open type electromagnetic clutches, normal close or normal open type electromagnetic switches, normal close or normal open type electromagnetic relays, normal close or normal open type solenoid valves, etc. as well as magnets, electromagnetic locks, spiral tube windings or other electromagnetic actuating devices with driving coils for driven by electromagnetic actuation effects, or multi-operating type electromagnetic actuating devices which can be driven by driving coils or operated by numerous manual or mechanical power methods, wherein individually installed driving coils of two or more than two electromagnetic actuating devices is operatively controlled by the switching device to actuate and be electrified to appear relatively lower impedance in parallel connection or series and parallel connection thereby causing the electromagnetic actuating device to produce a larger electromagnetic actuating power, wherein after the electromagnetic actuating devices are actuated, the individually installed driving coils of the two or more than two electromagnetic actuating devices being operatively controlled by the switching device are switched to appear relatively higher impedance in series connection or series and parallel connection thereby reducing currents passing through driving coils while required operating characteristics for individual electromagnetic actuating devices after electrification are still satisfied thereby saving electric power and reducing heat loss in the driving coils of the electromagnetic actuating devices.

DESCRIPTION OF MAIN COMPONENT SYMBOLS

101: Switching Device
102, 112: Electromagnetic actuating device
103, 113: Surge absorption device
102', 112': Driving coil
105, 115: Position detector device
Ia, Ib, Ic: Excited current

DETAILED DESCRIPTION OF THE PREFERRED EMBODIMENTS

The present invention discloses an operative control circuit of multiple electromagnetic actuating devices in series and parallel connections which is through the switching device to operatively control two or more than two electromagnetic actuating devices individually installed with driving coils including applications for normal close or normal open type electromagnetic brakes, normal close or normal open type electromagnetic clutches, normal close or normal open type electromagnetic switches, normal close or normal open type electromagnetic relays, normal close or normal open type solenoid valves, as well as magnets, electromagnetic locks, spiral tube windings or other electromagnetic actuating devices with driving coils for driven by electromagnetic actuation effects, or multi-operating type electromagnetic actuating devices which can be driven by driving coils or operated by numerous manual or mechanical power methods, wherein individually installed driving coils of two or more than two electromagnetic actuating devices is operatively controlled by the switching device to actuate and be electrified to appear relatively lower impedance in parallel connection or series and parallel connection thereby causing the electromagnetic actuating device to produce a larger electromagnetic actuating power, wherein after the electromagnetic actuating devices are actuated, the individually installed driving coils of the two or more than two electromagnetic actuating devices being operatively controlled by the switching device are switched to appear relatively higher impedance in series connection or series and parallel connection thereby reducing currents passing through driving coils while required operating characteristics for individual electromagnetic actuating devices after electrification are still satisfied thereby saving electric power and reducing heat loss in the driving coils of the electromagnetic actuating devices.

Figure 1:
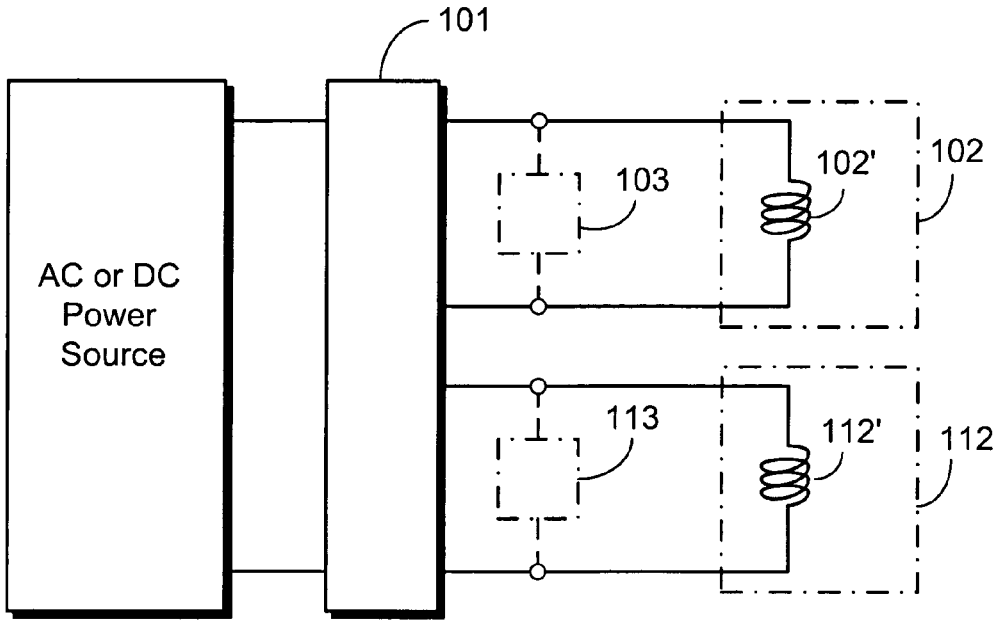
FIG. 1 is a circuit-block schematic view of an embodiment of the invention showing that the two electromagnetic actuating devices with individually installed driving coils are operated by the switching device for opening or closing, or series or parallel connection.
Figure 2:
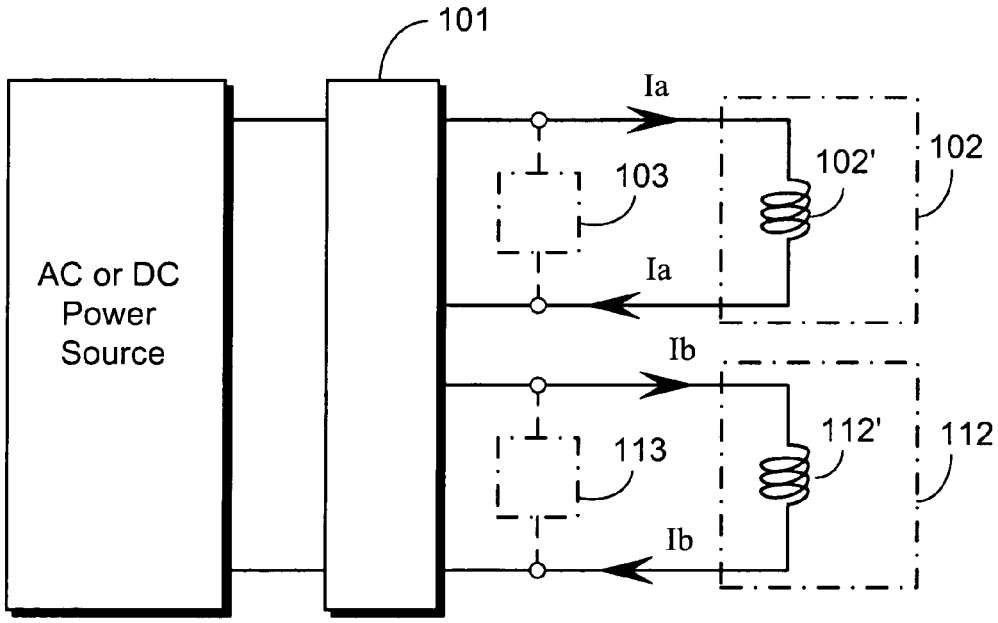
FIG. 2 is a circuit schematic view showing that driving coils in the embodiment of FIG. 1 are electrified to appear relatively lower impedance in a parallel connection or series and parallel connection.
Figure 3:
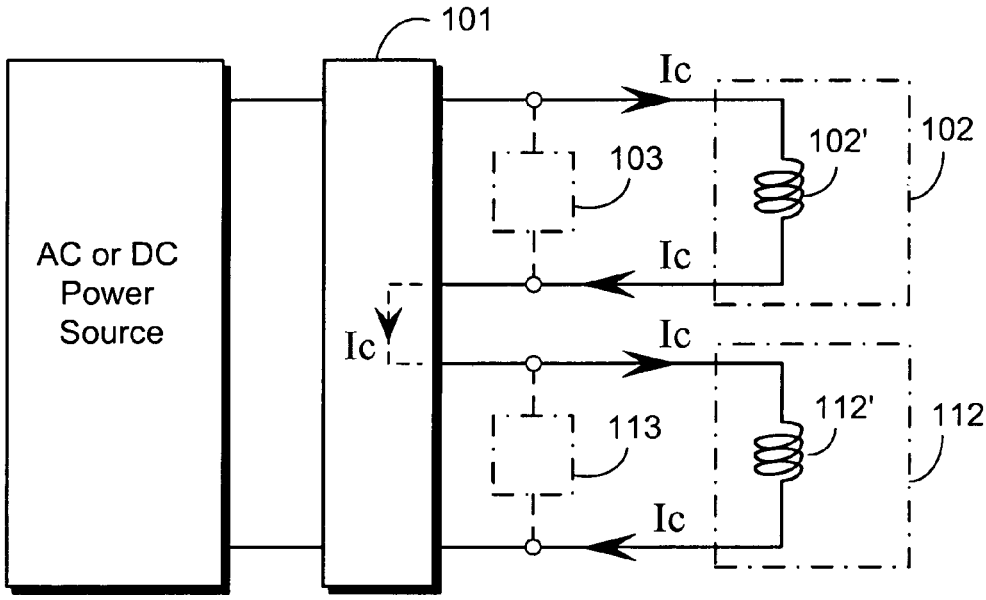
FIG. 3 is a circuit schematic view showing that individually installed driving coils of the two electromagnetic actuating devices in the embodiment of FIG. 1 are electrified to a appear relatively higher impedance in a series connection or series and parallel connection.

The operative control embodiment for the two electromagnetic actuating devices with driving coils in series or parallel connections are described in the following:

FIG. 1 is a circuit-block schematic view of an embodiment of the invention showing that the two electromagnetic actuating devices with individually installed driving coils are operated by the switching device for opening or closing, or series or parallel connection, wherein it mainly comprises:

A switching device (101): It is constituted by an electromechanical switch, electric relay, electromagnetic switch or a solid state switching device, operable by the manual, mechanical, fluid or electrical power for being operated by the manual, mechanical, fluid or electrical power is through supplying AC or DC power to individually installed driving coils (102'), (112') of electromagnetic actuating device (102) and electromagnetic actuating device (112) to provide a switching function for electrification and power cut-off, or it is through the switchover operation by the switching device (101) to first actuate individually installed driving coils (102'), (112') of the two electromagnetic actuating devices for electrification to appear relatively lower impedance in parallel connection or parallel and series connection for respectively passing excited currents (Ia), (Ib). FIG. 2 is a circuit schematic view showing that individually installed driving coils of the two electromagnetic actuating devices in the embodiment of FIG. 1 are electrified to appear a relatively lower impedance in a parallel connection or series and parallel connection. When they are electrified in parallel connection, individually installed driving coils (102'), (112') of the two electromagnetic actuating devices are then operatively controlled by the switching device (101) to be switched to appear relatively higher impedance in series connection or series and parallel connection, thereby allowing a smaller excited current (Ic) to commonly pass through driving coils (102'), (112') in series connection. FIG. 3 is a circuit schematic view showing that individually installed driving coils of the two electromagnetic actuating devices in the embodiment of FIG. 1 are electrified to a appear relatively higher impedance in a series connection or series and parallel connection, wherein the required characteristics for electrification actuation status of individual electromagnetic actuating devices shall still be satisfied by the electromagnetic actuating devices with relatively higher impedance in series connection or series and parallel connection at the electrification status.

The individually installed driving coils (102'), (112') of at least two electromagnetic actuating devices in parallel connection or series and parallel connection to appear relatively lower impedance are operatively controlled by the switching device to be switched to the series connection or series and parallel connection to appear relatively higher impedance, wherein the switchover methods include:

(1) The individually installed driving coils (102'), (112') of two or more than two electromagnetic actuating devices are operatively controlled by manual-sequential operating switching device (101) for switchover in the parallel connection or series and parallel connection to appear a relatively lower impedance, or in the series connection or series and parallel connection to appear a relatively higher impedance; or (2) The individually installed driving coils (102'), (112') of two or more than two electromagnetic actuating devices in parallel connection or series and parallel connection to appear a relatively lower impedance are operatively controlled by the operative switching device (101) with a time delay function to be switched to a series connection or series and parallel connection to appear a relatively higher impedance after a time delay; or (3) By detecting current values passing through the switching device (101) to driving coils (102'), (112'), when individually installed driving coils (102'), (112') of two or more than two electromagnetic actuating devices are electrified to actuate excited current value≧setting current value, or ≧the status of setting current value status exceeding over setting time, the switching device (101) is driven to operatively control driving coils (102'), (112') in series connection or series and parallel connection to appear a relatively higher impedance; or (4) The switching device (101) is operatively controlled by two or more than two methods of the above said (1)(2)(3);

The electromagnetic actuating devices (102), (112): They are constituted by conventional devices structures with individually installed AC or DC powered driving coils (102'), (112') such as normal close or normal open type electromagnetic brakes, normal close or normal open type electromagnetic clutches, normal close or normal open type electromagnetic switches, normal close or normal open type electromagnetic relays, normal close or normal open type solenoid valves, etc. as well as magnets, electromagnetic locks, spiral tube windings or other electromagnetic actuating devices with driving coils for driven by electromagnetic actuation effects, or multi-operating type electromagnetic actuating devices which can be driven by driving coils or operated by numerous manual or mechanical power methods; wherein the driving coil (102') of the electromagnetic actuating device (102) and the driving coil (112') of the electromagnetic actuating device (112) to appear a relatively lower impedance in a parallel connection or series and parallel connection being operatively controlled by the switching device (101) for electrification is switched to appear relatively higher impedance in series connection or series and parallel connection thereby saving electric power and reducing heat generation, while the required characteristics for electrification actuation status of individual electromagnetic actuating devices (102), (112) shall still be satisfied by the individually installed driving coils (102'), (112') of electromagnetic actuating devices (102), (112) with relatively higher impedance in series connection or series and parallel connection at the electrification status.

Said individual driving coils (102'), (112') can be optionally constituted by conducting wires of the same or different material or the same or different conduction cross-section areas, or constituted by windings with the same or different numbers of coils;

The surge absorption devices (103), (113): The AC or DC surge absorption devices being optionally installed according to specifications of electromagnetic actuating devices are respectively parallel connected with driving coils (102'), (112') to help absorbing the produced inductance of counter-electric potential in driving coils (102'), (112') when driving coils (102'), (112') are operated by the switching device (101) to open or close, or to appear relatively lower impedance in parallel connection or series and parallel connection, or to be switched to relatively higher impedance in series connection or series and parallel connection, wherein the surge absorption device is constituted by the following: (1) When driving coils (102'), (112') are powered by AC power, AC surge absorption device (103) is installed, such as that it can be constituted by a bipolar solid state varistor, or constituted by at least two kinds of components of the resistors, inductors, bipolar capacitors in series connection, parallel connection or series and parallel connection, or constituted by the bipolar capacitor alone, or constituted by other conventional AC surge absorption circuit devices; (2) When driving coils (102'),(112') are powered by lower voltage DC power, DC surge absorption device (113) is installed, such as that it can be constituted by reverse polarity diodes in parallel connection to appear a flywheel diode with energy storage effect, or constituted by at least two kinds of components of the resistors, inductors, uni-polar or bipolar capacitors, or constituted by the uni-polar or bipolar capacitor alone, or constituted by the solid state varistor or other conventional DC surge absorption devices; wherein this device can be optionally installed or not installed as required.

In practical applications, driving coils of the individual electromagnetic devices of the operative control circuit of multiple electromagnetic actuating devices in series and parallel connections include the following:

(1) It is constituted by driving coils with the same or different electromechanical characteristics;

(2) The driving coil of the individual electromagnetic actuating device is one set in ordinary status and can also be two or more than two sets as needed;

(3) When the individual electromagnetic actuating device has two or more than two sets of driving coils, they can be operatively controlled by a switching device (101) to switch between the series and parallel connections, and further to switch between series and parallel connections with driving coils of other electromagnetic actuating devices.

Figure 4:
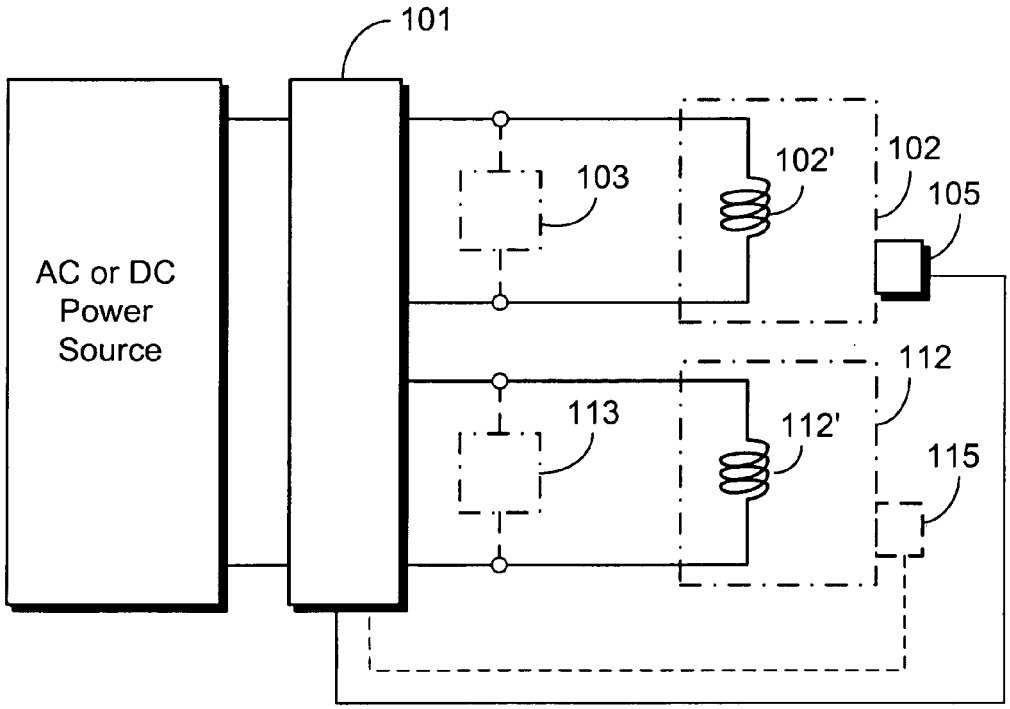
FIG. 4 is a circuit-block schematic view of the invention showing that the position detector device is installed in the electromagnetic actuating device to operatively control driving coils.

For the operative control circuit of multiple electromagnetic actuating devices in series and parallel connections, the methods for at least two driving coils (102'), (112') to appear relatively lower impedance in parallel connection or series and parallel connection being switched to appear relatively higher impedance in series connection or series and parallel connection further include such as that FIG. 4 is a circuit-block schematic view of the invention showing that the position detector device is installed in the electromagnetic actuating device to operatively control driving coils, and it includes:

(1) The position of the rotor and stator of one of the electromagnetic actuating devices after electrification, or the selected position during the actuating process is individually installed with a position detector device (105), wherein after driving coils (102'), (112') of the electromagnetic actuating devices being switched to appear relatively lower impedance in parallel connection or series and parallel connection are electrified, the normal electrification of the rotor and stator of their belonging electromagnetic actuating device is detected by the position detector device (105) of one of the individual electromagnetic actuating devices to directly switch the said driving coils (102'), (112') of the two or more than two electromagnetic actuating devices from relatively lower impedance in parallel connection or series and parallel connection to relatively higher impedance in series connection or series and parallel connection; or the normal electrification of the rotor and stator of their belonging electromagnetic actuating device is detected by the position detector device (105) of one of the individual electromagnetic actuating devices to operatively control a switching device (101), and further through the switching device (101) to operatively control the individually installed driving coils (102'), (112') of two or more than two electromagnetic actuating devices from relatively lower impedance in parallel connection or series and parallel connection to relatively higher impedance in series connection or series and parallel connection;

(2) The positions of the rotors and stators of two or more than two electromagnetic actuating devices after electrification, or the selected positions during the actuating process are individually installed with the position detector devices (105), (115) wherein after driving coils (102'), (112') of the electromagnetic actuating devices being switched to appear relatively lower impedance in parallel connection or series and parallel connection are electrified, and further through the interactive operative controls between the individually installed position detector devices (105), (115), the normal electrification of the rotors and stators of their belonging electromagnetic actuating devices are detected by all of the individually installed position detector devices (105), (115) to directly switch the individually installed driving coils (102'), (112') of the two or more than two electromagnetic actuating devices from relatively lower impedance in parallel connection or series and parallel connection to relatively higher impedance in series connection or series and parallel connection; or the normal electrifications of the rotors and stators of their belonging electromagnetic actuating devices are detected by all of the individually installed position detector devices (105), (115) to operatively control a switching device (101), and further through the switching device (101) to operatively control the individually installed driving coils (102'), (112') of the two or more than two electromagnetic actuating devices from relatively lower impedance in parallel connection or series and parallel connection to relatively higher impedance in series connection or series and parallel connection;

The position detector devices (105), (115) can be constituted by pressure sensing type electromechanical switching devices or pressure-actuating spring leaf type switches, or can be constituted by optical, electromagnetic inducing type, capacitive inducing type or other conventional position sensing devices, wherein this device can be optionally installed or not installed as required.

As summarized from the above descriptions, the operative control circuit of multiple electromagnetic actuating devices in series and parallel connection, wherein it is characterized in that the installed driving coils of the two or more than two individual electromagnetic actuating devices can be electrified to appear relatively lower impedance in a parallel connection or series and parallel connection so as to allow electromagnetic driving device to obtain the larger actuating power and response characteristics, and further through operative control on the switching device to switch the installed driving coils of the two or more than two electromagnetic actuating devices to appear a relatively higher impedance electrification status in a series connection or series and parallel connection thereby ensuring the electromagnetic actuating devices to appear electrification after actuation as well as saving electric power and reducing heat generation.

The invention claimed is:

1. An operative control circuit for multiple electromagnetic actuating devices, comprising:

individual driving coils in respective said electromagnetic actuating devices; and a switching device for supplying power from a power source to said driving coils of said electromagnetic actuating devices, wherein:

said driving being coils are initially connected to form a first circuit in which said driving coils are connected to said power source through said switching device and driven in parallel, and said driving coils are subsequently connected to form a second circuit in which said driving coils are connected to said power source through said switching device and further connected to each other in series, wherein said second circuit has a relatively high impedance compared to the first circuit to thereby reduce a current drawn by the electromagnetic actuating devices, saving power and reducing heat generation.

2. An operative control circuit as claimed in claim 1, wherein said power source is a DC power source.

3. An operative control circuit as claimed in claim 1, wherein said power source is an AC power source.

4. An operative control circuit as claimed in claim 1, wherein the driving coils are operatively controlled by a manual-sequential operating switching device.

5. An operative control circuit as claimed in claim 1, wherein the driving coils are operatively controlled by an operative switching device with a time delay function.

6. An operative control circuit as claimed in claim 1, wherein the driving coils are operatively controlled in response to detection of current values passing through the switching device to the driving coils, said switching device connecting said driving coils in series to form said second relatively high impedance circuit when said current values exceed a preset current value or detection of said current values has exceeded a preset time.

7. An operative control circuit as claimed in claim 1, wherein said driving coils have at least one of a same material, a same cross-sectional area, and a same number of coils.

8. An operative control circuit as claimed in claim 1, wherein said driving coils have at least one of different materials, different cross-sectional areas, and different numbers of coils.

9. An operative control circuit as claimed in claim 1, wherein said driving coils have same electromechanical characteristics.

10. An operative control circuit as claimed in claim 1, wherein said driving coils have different electromechanical characteristics.

11. An operative control circuit as claimed in claim 1, wherein said driving coils are arranged to be switched from one set to multiple sets.

12. An operative control circuit as claimed in claim 2, wherein said switching device is arranged to switch said sets of driving coils between series and parallel connections.

13. An operative control circuit as claimed in claim 1, further comprising position detecting devices for detecting respective positions of the electromagnetic actuating devices and controlling said switching device to switch between said relatively low impedance first circuit and said relatively high impedance second circuit in response to detected positions of said actuating devices.

14. An operative control circuit as claimed in claim 1, further comprising surge absorption devices connected in parallel with said driving coils, between said driving coils and said switching device.

15. An operative control circuit as claimed in claim 1, wherein the electromagnetic actuating devices are normally closed or open electromagnetic brakes.

16. An operative control circuit as claimed in claim 1, wherein the electromagnetic actuating devices are normally closed or open electromagnetic clutches.

17. An operative control circuit as claimed in claim 1, wherein the electromagnetic actuating devices are normally closed or open electromagnetic switches.

18. An operative control circuit as claimed in claim 1, wherein the electromagnetic actuating devices are normally closed or open electromagnetic relays.

19. An operative control circuit as claimed in claim 1, wherein the electromagnetic actuating devices are normally closed or open solenoid valves.

20. An operative control circuit as claimed in claim 1, wherein the electromagnetic actuating devices are selected from the group consisting of magnets, electromagnetic locks, and spiral tube windings.

* * * * *